US006510409B1

(12) United States Patent
Su

(10) Patent No.: US 6,510,409 B1
(45) Date of Patent: Jan. 21, 2003

(54) INTELLIGENT DISCONTINUOUS TRANSMISSION AND COMFORT NOISE GENERATION SCHEME FOR PULSE CODE MODULATION SPEECH CODERS

(75) Inventor: Huan-Yu Su, San Clemente, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/484,731

(22) Filed: Jan. 18, 2000

(51) Int. Cl.[7] ..... G10L 11/02
(52) U.S. Cl. ..... 704/233; 704/205
(58) Field of Search ..... 704/220, 219, 704/215, 226, 227, 264, 221, 223, 228, 201, 266, 205, 206, 207

(56) References Cited

U.S. PATENT DOCUMENTS 5,778,338 A * 7/1998 Jacobs et al. ..... 704/200.1
5,960,389 A * 9/1999 Jarvinen et al. ..... 704/215

* cited by examiner

*Primary Examiner*—Richemond Dorvil
(74) *Attorney, Agent, or Firm*—Farjami & Farjami LLP

(57) ABSTRACT

A fully backward compatible intelligent discontinued transmission (DTX) and comfort noise generation (CNG) scheme that is operable in pulse code modulation (PCM) speech coding systems. The scheme, for example, provides a speech encoder comprising a speech signal analysis circuitry configured to calculates a predetermined plurality of parameters from the speech signal, a voice activity detector configured to determine voice activity in the speech signal, where the speech encoder enters a discontinued transmission mode of the voice activity detector does not detect voice activity, and a transmitter configured to transmit one or more speech samples of the speech signal after the speech encoder enters the discontinued transmission mode, where the one or more speech samples are capable of use by a remote speech decoder to extract a parameter from the one or more speech samples in order generate a background noise base on the parameter.

18 Claims, 9 Drawing Sheets

INTELLIGENT DISCONTINUOUS TRANSMISSION AND COMFORT NOISE GENERATION SCHEME FOR PULSE CODE MODULATION SPEECH CODERS

BACKGROUND

1. Technical Field

The present invention relates generally to speech coding; and, more particularly, it relates to discontinued transmission and comfort noise generation within pulse code modulation (PCM) type of speech coders.

2. Related Art

Conventional methods of performing discontinued transmission (DTX) mode speech coding typically employs only energy level detection of background noise. That is to say, a single measure of the energy level is detected in an encoder circuitry of a speech codec, and an energy level flag is transmitted across a communication link to a decoder circuitry of the speech codec. At the decoder circuitry of the speech codec, some form of speech signal generation is performed after having received this energy level flag during the inception of discontinued transmission (DTX) modes of operation. Examples that are used to perform this comfort noise generation (CNG) in the art include utilizing a randomly selected or randomly generated sequence in a PCM coder (like the $\mu$-Law/A-Law PCM G.711), and employing the randomly selected or the randomly generated codevector within a code-excited linear prediction (CELP) speech reproduction circuitry (like G.729 Annex B), to generate comfort noise at the decoder circuitry during discontinued transmission (DTX) modes of operation.

However, using this single dimensional method of encoding the background noise (energy level) of speech coding system fails to provide a high perceptual quality of reproduced background noise at the decoder circuitry of the speech codec. For example, the conventional method of employing the energy level alone simply does not provide the high perceptual quality of background noise that users of speech coding system expect.

One proposed method of ensuring a high perceptual quality of the coding of background noise in speech coding systems is to measure and transmit both a frequency spectrum and an energy level of a speech signal and transmit that information from the encoder circuitry to the decoder circuitry of the speech codec. One difficulty presented with the conventional methods that measure and transmit both the frequency spectrum and the energy level of the speech signal is that they inherently require a modification of the existing transmission protocols and standards. There is an inherent inability in such proposed solutions to be operable with the existing transmission protocols and standards. An entirely new silence insertion description (SID) standard would need to be designed to be able to interface with the conventionally proposed speech coding methods that are capable of ensuring a high perceptual quality of background noise within speech signals.

For example, the proposed conventional methods that measure and transmit both the frequency spectrum and the energy level of the speech signal inherently require the entirely new silence insertion description (SID) standard to be able to comply with and perform conventional speech coding operations such as discontinued transmission (DTX). To provide comfort noise generation (CNG) and other desirable speech coding methods that are operable to provide a high perceptual quality for applications such as speech coding of music, comfort noise generation (CNG), and other perceptual improvements that provide for increased quality for users would intrinsically require additional transformation to comply with existing speech coding standards. To provide this additional functionality, the inherently increased complexity of the overall speech coding system would result in a significant increase in size and cost. While there does exist a desire among those skilled in the art of speech coding, the presently conventional proposed methods, in that they do provide for improved perceptually quality of such speech signal elements such as background noise, they do not provide for operability with conventional transmission protocols, particularly those employing pulse code modulation (PCM).

Further limitations and disadvantages of conventional and traditional systems will become apparent to one of skill in the art through comparison of such systems with the present invention as set forth in the remainder of the present application with reference to the drawings.

SUMMARY OF THE INVENTION

Various aspects of the present invention can be found in a speech codec that performs discontinued transmission on a speech signal having a background noise. The speech codec contains, among other things, an encoder circuitry and a decoder circuitry communicatively coupled via a communication link. The encoder circuitry is operable to receive the speech signal having the background noise. The encoder circuitry itself contains, among other things, a background noise detection circuitry that detects a frequency spectrum and an energy level corresponding to the speech signal and a transmission resuming circuitry that operates cooperatively with the background noise detection circuitry to determine when to resume transmission of the speech signal. The decoder circuitry generates a reproduced speech signal that is substantially comparable to the speech signal. The decoder circuitry itself contains, among other things, a background noise reproduction circuitry that employs a predetermined number of relatively recently received speech samples to assist in the generation of a reproduced background noise that is itself contained within the reproduced speech signal. The reproduced background noise is substantially comparable to the background noise within the speech signal. The communication link is operable using a number of transmission protocols including conventional transmission protocols.

In certain embodiments of the invention, the background noise reproduction circuitry further contains a frequency spectrum derivation circuitry that re-synthesizes frequency spectrum for the reproduced speech signal and an energy level change derivation circuitry that re-synthesizes an energy level for the reproduced speech signal. The background noise detection circuitry further contains a frequency spectrum change detection circuitry that detects a change in the frequency spectrum corresponding to the speech signal, and an energy level change detection circuitry that a detects a change in the energy level corresponding to the speech signal. Furthermore, the encoder circuitry further contains an intelligent discontinued transmission circuitry that operates cooperatively with the background noise detection circuitry to detect the change in the frequency spectrum corresponding to the speech signal and the change in the energy level corresponding to the speech signal. This information is used to determine when to resume transmission of the speech coding on the speech signal.

In other embodiments of the invention, the encoder circuitry further contains a systematic discontinued transmission circuitry that resumes transmission of the speech coding on the speech signal at time intervals determined beforehand. The predetermined number of relatively recently received speech samples is a frame of the speech signal. The predetermined number of relatively recently received speech samples includes a frequency spectrum corresponding to the predetermined number of relatively recently received speech samples and an energy level corresponding to the predetermined number of relatively recently received speech samples.

Other aspects of the present invention can be found in a speech codec that performs an intelligent discontinued transmission speech coding on a speech signal. The speech codec contain, among other things, a speech signal analysis circuitry that calculates a predetermined number of parameters from the speech signal and a background noise detection circuitry that detects a change of at least one of the predetermined number of parameters that is calculated from the speech signal using the speech signal analysis circuitry. The speech codec resumes transmission of a speech coding on the speech signal upon the detection of the change of the at least one of the predetermined number of parameters.

In certain embodiments of the invention, the predetermined number of parameters from the speech signal comprises a frequency spectrum and an energy level of the speech signal. The change of the at least one of the predetermined number of parameters is detected when the background noise detection circuitry compares the change against a predetermined threshold.

If desired, the speech codec further contains an encoder circuitry, a decoder circuitry, and a communication link that communicatively couples the encoder circuitry and the decoder circuitry. The transmission of the speech coding on the speech signal, performed upon the detection of the change of the at least one of the predetermined number of parameters, is resumed across the communication link. The encoder circuitry further contains an intelligent discontinued transmission circuitry that operates cooperatively with the background noise detection circuitry to detect the change of the at least one of the predetermined number of parameters that is calculated from the speech signal using the speech signal analysis circuitry.

In other embodiments of the invention, the encoder circuitry further contains a systematic discontinued transmission circuitry that resumes transmission of the speech coding on the speech signal at predetermined time intervals. The speech signal comprises a background noise, and the speech codec produces a reproduced speech signal wherein the reproduced speech signal contains a reproduced background noise. The reproduced background noise is substantially indistinguishable from the background noise contained within the speech signal. The speech codec re-synthesizes the background noise using a predetermined number of speech samples corresponding to the speech signal, and the predetermined number of speech samples are a relatively recently sampled number of speech samples corresponding to the speech signal.

Other aspects of the present invention can be found in a method that performs discontinued transmission on a speech signal. The method includes discontinuing transmission of a speech signal, detecting a change in a frequency spectrum of the speech signal, detecting a change in a energy level of the speech signal, and resuming transmission of the speech signal upon detection of at least one of the change in the frequency spectrum of the speech signal and the change in the energy level of the speech signal.

In certain embodiments of the invention, the method further includes resuming transmission of the speech signal upon detection of both the change in the frequency spectrum of the speech signal and the change in the energy level of the speech signal. The method further includes re-synthesizing a number of speech samples using a relatively recently sampled number of speech samples. The relatively recently sampled number of speech samples are extracted from the speech signal. The method further includes resuming transmission of the speech signal at predetermined time intervals. If desired, the change in the frequency spectrum of the speech signal is determined by comparing a predetermined threshold, and the change in the energy level of the speech signal is determined by comparing a predetermined threshold.

Other aspects, advantages and novel features of the present invention will become apparent from the following detailed description of the invention when considered in conjunction with the accompanying drawings.

DETAILED DESCRIPTION OF THE INVENTION

The present invention provides a system that provides and maintains a high perceptual quality of background noise contained within a speech signal. This maintenance of the high perceptual quality of the background noise is especially desirable within speech coding systems that perform discontinued transmission (DTX) and its associated comfort noise generation (CNG) contained therein. In addition, the invention offers a solution that is completely fully backward compatible with existing speech coding systems. This is especially desirable within pulse code modulation (PCM) speech coding systems that have inherently limited design constraints as described above in the related art.

Figure 1:
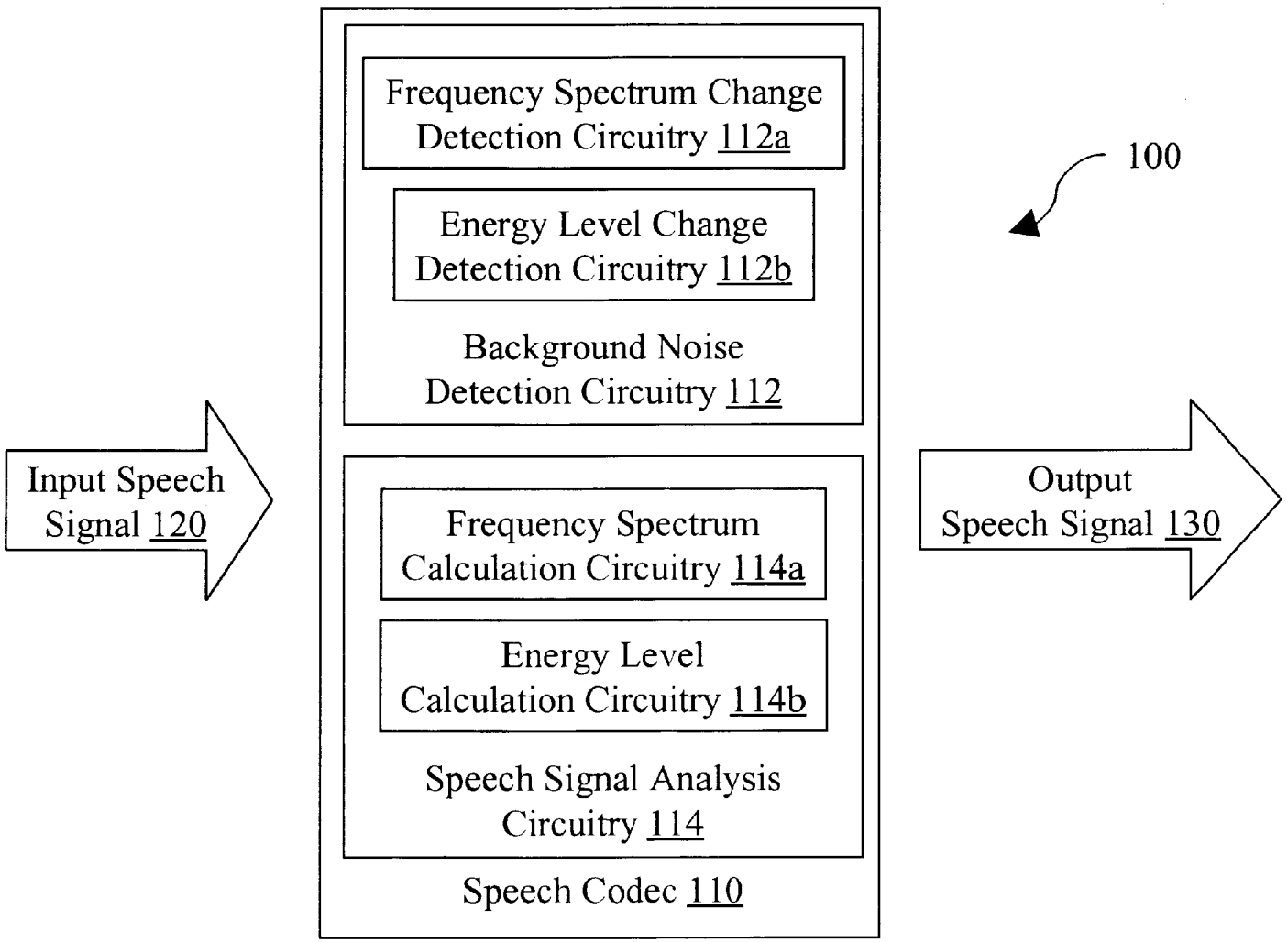
FIG. 1 is a system diagram illustrating one embodiment of a speech coding system built in accordance with the present invention.

FIG. 1 is a system diagram illustrating one embodiment of a speech coding system 100 built in accordance with the present invention. The speech coding system 100 contains, among other things, a speech codec 110. The speech codec 110 receives an input speech signal 120 and generates an output speech signal 130. The speech codec 110 itself contains, among other things, a background noise detection circuitry 112 and a speech signal analysis circuitry 114. The background noise detection circuitry 112 itself contains, among other things, a frequency spectrum change detection circuitry 112*a* and an energy level change detection circuitry 112*b*. The speech signal analysis circuitry 114 itself contains, among other things, a frequency spectrum change calculation circuitry 114*a* and an energy level change calculation circuitry 114*b*.

In certain embodiments of the invention, the speech signal analysis circuitry 114 employs the frequency spectrum change calculation circuitry 114*a* and the energy level change calculation circuitry 114*b* to extract and calculate a frequency spectrum and an energy level from the input speech signal 120. In addition, the background noise detection circuitry 112 employs the frequency spectrum change detection circuitry 112*a* and the energy level change detection circuitry 112*b* to detect any change in the frequency spectrum and the energy level from the input speech signal 120. That is to say, the background noise detection circuitry 112 monitors for any changes of a background noise within the input speech signal 120. In the event of any change in the frequency spectrum and the energy level within the input speech signal 120, the speech codec 110 is operable to modify the method of transformation performed to convert the input speech signal 120 into the output speech signal 130. If desired, the speech codec 110 is operable to perform discontinued transmission (DTX), and the speech codec 110 employs the background noise detection circuitry 112, and the frequency spectrum change detection circuitry 112*a* and the energy level change detection circuitry 112*b* contained therein, to monitor any changes in the frequency spectrum and the energy level of the input signal 120. In addition, if there is a sufficiently appreciable change in one or both of the frequency spectrum or the energy level of the input signal 110, the speech codec 110 modifies the method of transformation performed to convert the input speech signal 120 into the output speech signal 130.

Figure 2:
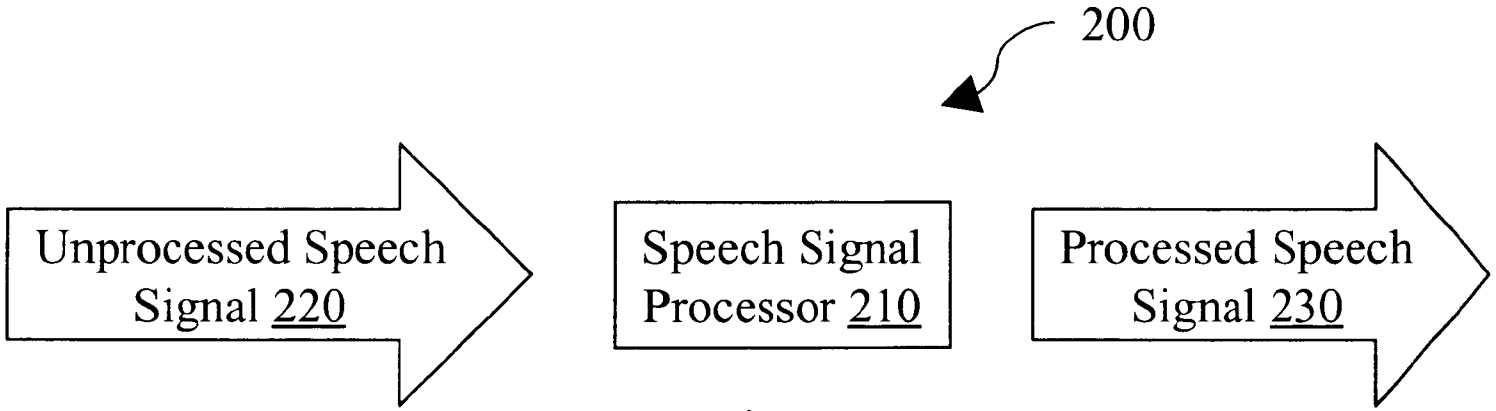
FIG. 2 is a system diagram illustrating one embodiment of a speech signal processing system built in accordance with the present invention.

FIG. 2 is a system diagram illustrating one embodiment of a speech signal processing system 200 built in accordance with the present invention. The speech signal processor 210 receives an unprocessed speech signal 220 and produces a processed speech signal 230.

In certain embodiments of the invention, the speech signal processor 210 is processing circuitry that performs the loading of the unprocessed speech signal 220 into a memory from which selected portions of the unprocessed speech signal 220 are processed in various manners including a sequential manner. The processing circuitry possesses insufficient processing capability to handle the entirety of the unprocessed speech signal 220 at a single, given time. The processing circuitry may employ any method known in the art that transfers data from a memory for processing and returns the processed speech signal 230 to the memory. In other embodiments of the invention, the speech signal processor 210 is a system that converts a speech signal into encoded speech data. The encoded speech data is then used to generate a reproduced speech signal that is substantially perceptually indistinguishable from the speech signal using speech reproduction circuitry. In other embodiments of the invention, the speech signal processor 210 is a system that converts encoded speech data, represented as the unprocessed speech signal 220, into decoded and reproduced speech data, represented as the processed speech signal 230. In other embodiments of the invention, the speech signal processor 210 converts encoded speech data that is already in a form suitable for generating a reproduced speech signal that is substantially perceptually indistinguishable from the speech signal, yet additional processing is performed to improve the perceptual quality of the encoded speech data for reproduction.

The speech signal processing system 200 is, in some embodiments, the speech coding system 100 as described in the FIG. 1. The speech signal processor 210 operates to convert the unprocessed speech signal 220 into the processed speech signal 230. The conversion performed by the speech signal processor 210 is viewed, in various embodiments of the invention, as taking place at any interface wherein data must be converted from one form to another, i.e. from speech data to coded speech data, from coded data to a reproduced speech signal, etc. The speech coding performed in accordance with the present invention is performed, in various embodiments of the invention, within the speech signal processor 210. From certain perspectives, the conversion of the unprocessed speech signal 220 into the processed speech signal 230 is the extraction of the linear prediction coefficients (LPCs) and the combination of the linear prediction coefficients (LPCs), as described above in the various embodiments of the invention.

Figure 3:
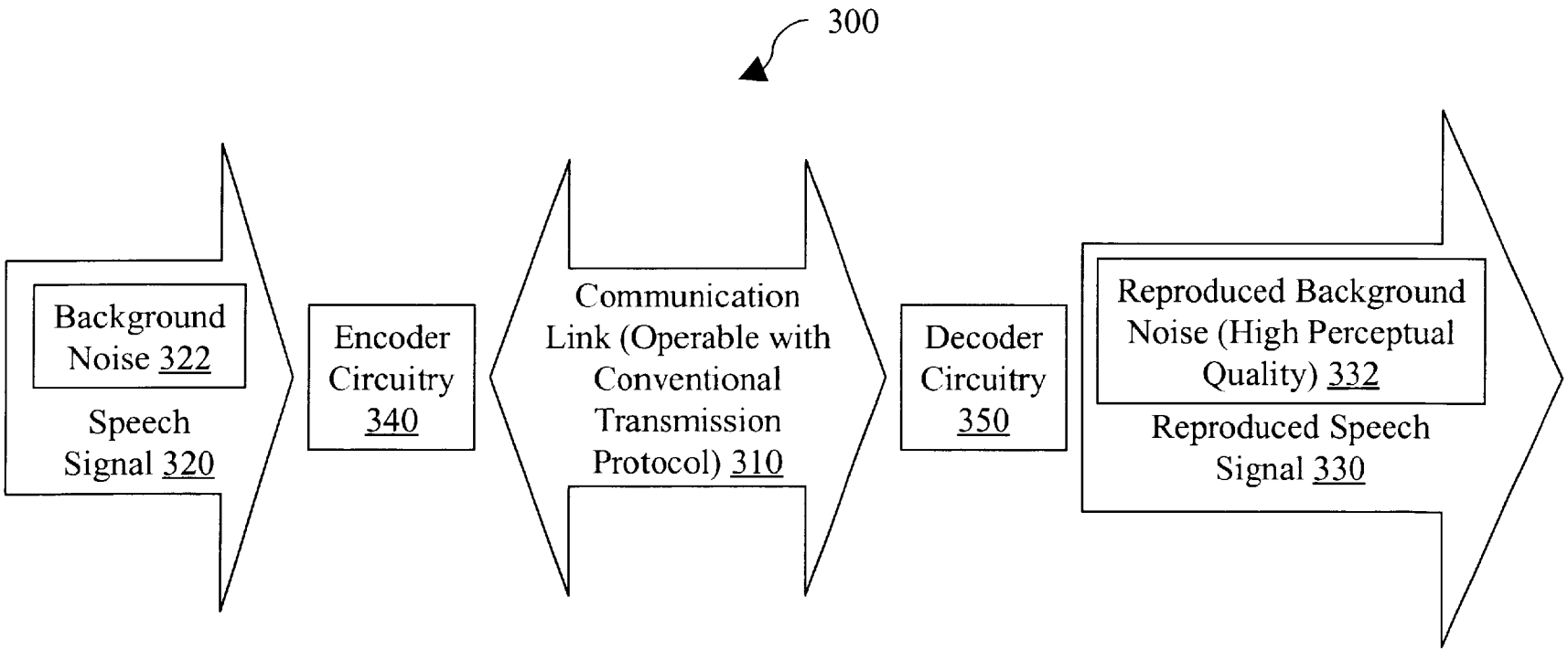
FIG. 3 is a system diagram illustrating one embodiment of a speech codec built in accordance with the present invention.

FIG. 3 is a system diagram illustrating one embodiment of a speech codec 300 built in accordance with the present invention. The speech codec 300 employs an encoder circuitry 340 and a decoder circuitry 350 to transform a speech signal 320 into a reproduced speech signal 330. The encoder circuitry 340 transforms the speech signal 320 into a form suitable for transmission via a communication link 310. If desired, the transmission protocol employed across the communication link 310 is operable with conventional transmission protocols. Any number of additional transmission protocols are operable using the communication link 310. The speech signal 320 itself contains, among other things, a background noise 322. The reproduced speech signal 330 itself contains, among other things, a reproduced background noise 332 that is of a high perceptual quality. The perceptual quality of the reproduced background noise 332 contained within the reproduced speech signal 330 is substantially indistinguishable from the background noise 322 contained within the speech signal 320.

In certain embodiments of the invention, information corresponding to a frequency spectrum and an energy level of the speech signal 320 are used to perform the speech coding of the speech signal 320 in accordance with the present invention. When the speech codec 300 begins to operate within a discontinued transmission (DTX) mode, a predetermined number of frames of the speech signal 320 are transmitted from the encoder circuitry 340 to the decoder circuitry 350 via the communication link 310. If desired, one single frame of the speech signal 320 is transmitted from the encoder circuitry 340 to the decoder circuitry 350 via the communication link 310 after the discontinued transmission (DTX) mode of operation has been invoked. Using the predetermined number of frames of the speech signal 320, or the one single frame of the speech signal 320 in other embodiments of the invention, the reproduced speech signal 330 is re-synthesized to provide the perceptually comforting comfort noise generation (CNG) to a user of the speech codec 300.

In addition, speech codec 300 is operable to detect any change in the frequency spectrum and the energy level of the speech signal 320 and to modify the speech coding performed therein. Upon the detection of any change in the frequency spectrum and the energy level of the speech signal 320 being beyond a predetermined threshold for each of the parameters of the frequency spectrum and the energy level, the speech codec 300 re-initiates the discontinued transmission (DTX) mode of operation using the new frequency spectrum and the energy level of the speech signal 320. This updating or refreshing of the frequency spectrum and the energy level of the speech signal 320 upon the ensure a high perceptual quality of the reproduced speech signal 330, namely, a high perceptual quality of the reproduced background noise 332 contained within the reproduced speech signal 330.

Figure 4:
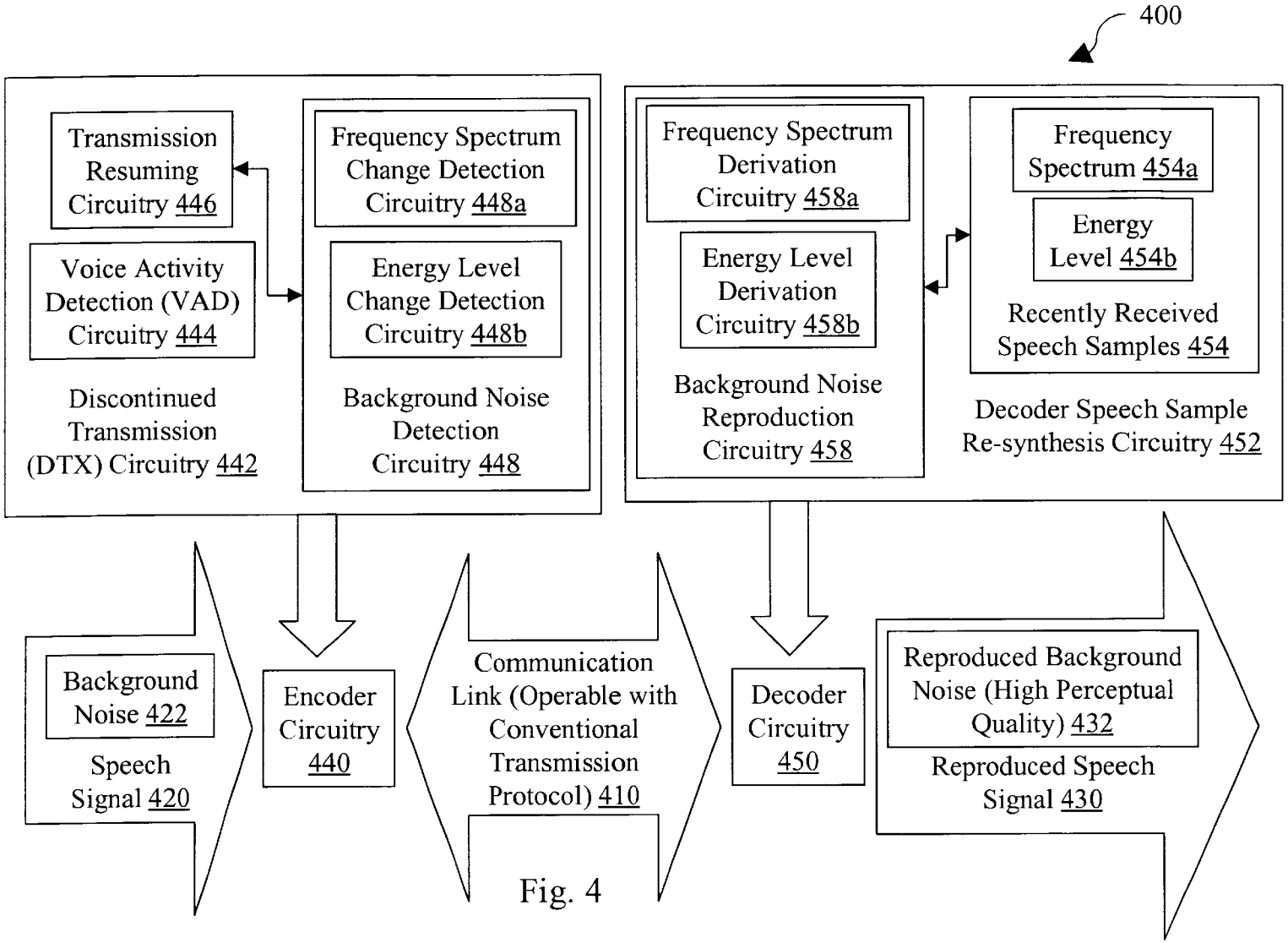
FIG. 4 is a system diagram illustrating another embodiment of a speech codec built in accordance with the present invention.

FIG. 4 is a system diagram illustrating another embodiment of a speech codec 400 built in accordance with the present invention. The speech codec 400 employs an encoder circuitry 440 and a decoder circuitry 450 to transform a speech signal 420 into a reproduced speech signal 430. The encoder circuitry 440 transforms the speech signal 420 into a form suitable for transmission via a communication link 410. If desired, the transmission protocol employed across the communication link 410 is operable with conventional transmission protocols. Any number of additional transmission protocols are operable using the communication link 410. The speech signal 420 itself contains, among other things, a background noise 422. The reproduced speech signal 430 itself contains, among other things, a reproduced background noise 432 that is of a high perceptual quality. The perceptual quality of the reproduced background noise 432 contained within the reproduced speech signal 430 is substantially indistinguishable from the background noise 422 contained within the speech signal 420.

In certain embodiments of the invention, information corresponding to a frequency spectrum and an energy level of the speech signal 420 are used to perform the speech coding of the speech signal 420 in accordance with the present invention. When the speech codec 400 begins to operate within a discontinued transmission (DTX) mode, a predetermined number of frames of the speech signal 420 are transmitted from the encoder circuitry 440 to the decoder circuitry 450 via the communication link 410. If desired, one single frame of the speech signal 420 is transmitted from the encoder circuitry 440 to the decoder circuitry 450 via the communication link 410 after the discontinued transmission (DTX) mode of operation has been invoked. Using the predetermined number of frames of the speech signal 420, or the one single frame of the speech signal 420 in other embodiments of the invention, the reproduced speech signal 430 is re-synthesized to provide the perceptually comforting comfort noise generation (CNG) to a user of the speech codec 400.

In addition, speech codec 400 is operable to detect any change in the frequency spectrum and the energy level of the speech signal 420 and to modify the speech coding performed therein. Upon the detection of any change in the frequency spectrum and the energy level of the speech signal 420 being beyond a predetermined threshold for each of the parameters of the frequency spectrum and the energy level, the speech codec 400 re-initiates the discontinued transmission (DTX) mode of operation using the new frequency spectrum and the energy level of the speech signal 420. From some perspectives, transmission is resumed between the encoder circuitry 440 and the decoder circuitry 450 via the communication link 410, whenever there is an appreciable change in either one of the frequency spectrum or the energy level of the speech signal 420. If desired, a decision to resume transmission is performed when there is an appreciable change in both the frequency spectrum and the energy level of the speech signal 420. Variations of the invention, including performing calculating weighted averages of the frequency spectrum and the energy level of the speech signal 420, are performed without departing from the scope and spirit of the invention. This updating or refreshing of the frequency spectrum and the energy level of the speech signal 420 upon the ensure a high perceptual quality of the reproduced speech signal 430, namely, a high perceptual quality of the reproduced background noise 432 contained within the reproduced speech signal 430.

The encoder circuitry 440 itself contains, among other things, a discontinued transmission (DTX) circuitry 442. The discontinued transmission (DTX) circuitry 442 itself contains, among other things, a voice activity detection (VAD) circuitry 444, a background noise detection circuitry 448 that operates cooperatively with a transmission resuming circuitry 446. The background noise detection circuitry 448 itself contains, among other things, a frequency spectrum change detection circuitry **448*a* and an energy level change detection circuitry 448*b***.

The voice activity detection (VAD) circuitry 444 monitors the speech signal 420 to determine when to perform discontinued transmission (DTX). Once discontinued transmission (DTX) is invoked, the transmission resuming circuitry 446 is used to determine at which point during the discontinued transmission (DTX) mode of operation that transmission between the encoder circuitry 440 and the decoder circuitry 450, via the communication link 410, should resume to maintain a high perceptual quality of the background noise 422. That is to say, during comfort noise generation (CNG) and other periods of speech coding that is performed when there is no active voiced speech in the speech signal 420, one such example being the discontinued transmission (DTX) that is invoked by the discontinued transmission (DTX) circuitry 442, the speech codec 400 is operable to maintain a high perceptual quality of even the background noise 422 within the speech signal 420.

The decoder circuitry 450 itself contains, among other things, a decoder speech sample re-synthesis circuitry 452. The decoder speech sample re-synthesis circuitry 452 itself contains, among other things, a background noise reproduction circuitry 458. The background noise reproduction circuitry 458 itself contains, among other things, a frequency spectrum derivation circuitry **458*a* and an energy level derivation circuitry 458*b*. The background noise reproduction circuitry 458 employs a number of recently received speech samples 452 to perform re-synthesis of the speech signal 420 within the reproduced speech signal 430 in a manner that is substantially imperceptible from original speech signal 420. Specifically, the reproduced background noise 432 contained within the reproduced speech signal 430 is substantially imperceptible from the background noise 422 within the speech signal 420. During discontinued transmission (DTX), as determined by the discontinued transmission (DTX) circuitry 442 within the encoder circuitry 440, the speech codec 400 employs the decoder speech sample re-synthesis circuitry 452 to provide for comfort noise generation (CNG), in that, the reproduced speech signal 430 is generated with the reproduced background noise 432 contained therein. The decoder speech sample re-synthesis circuitry 452 retains a number of recently received speech samples 454. The recently received speech samples 454 consists of, at least, a frequency spectrum 454***a* and an energy level 454*b* corresponding to the recently received speech samples 454. Any number constitutes the total number of the recently received speech samples 454. For example, in certain embodiments of the invention, the recently received speech samples 454 is a single frame of the speech signal 420. In other embodiments of the invention, the recently received speech samples 454 is a predetermined number of frames of the speech signal 420 or a predetermined number of sub-frames of the speech signal 420. Any number of speech samples is used to constitute the recently received speech samples 454 without departing from the scope and spirit of the invention.

At the decoder circuitry 450, the frequency spectrum and the energy level of the speech signal 420 are derived using the background noise reproduction circuitry 458 and the frequency spectrum derivation circuitry 458*a* and the energy level derivation circuitry 458*b* contained therein. Specifically, when transmission is discontinued, as in the discontinued transmission (DTX) mode of operation, as determined by the discontinued transmission (DTX) circuitry 442 of the encoder circuitry 440, the decoder circuitry 450 simply re-synthesizes speech samples that are substantially perceptually indistinguishable from the speech signal 420 and the background noise contained therein, using the recently received speech samples 454 and the frequency spectrum 454*a* and the energy level 454*b* contained therein. That is to say, the background noise reproduction circuitry 458 uses the spectrum and energy information derived from the recently received speech samples 454 to re-synthesize the speech signal 420 and the background noise 422 contained therein during the discontinued transmission (DTX) mode of operation.

This embodiment of the invention provides for full backward compatibility with conventional speech coding systems. In addition, it allows a manufacturer of the speech codec 400 to decide of what kind of frequency spectrum and energy level information it wants to derive from the recently received speech samples 454 to re-synthesize the speech signal 420. In addition, how the comfort noise generation (CNG) is performed with the most economical approach is also left in the hands of the manufacturer of the speech codec 400. At the encoder circuitry 440, the use of the voice activity detection (VAD) circuitry 444 of a high quality and a high quality discontinued transmission (DTX) scheme as performed by the discontinued transmission (DTX) circuitry 442 ensure a balanced approach of two of the primary competing requirements of the speech codec 400 in maintaining a high perceptual quality of coding the background noise 422 and also maintaining desirable bit-savings by discontinuing transmission within the discontinued transmission (DTX) mode of operation.

The present invention provides for a perceptual quality during the discontinued transmission (DTX) mode of operation that is substantially comparable to the ITU-Recommendation G.729 Annex B comfort noise generation (CNG) standard because it employs the same information that is used for comfort noise generation (CNG). Those having skill in the art of speech coding systems are typically in agreement that the comfort noise generation (CNG) as provided by the ITU-Recommendation G.729 Annex B is perfectly meeting the perceptual quality expectation among users of speech coding systems for typical applications including those intended to be performed by the speech coded 400 as described within the invention.

Figure 5:
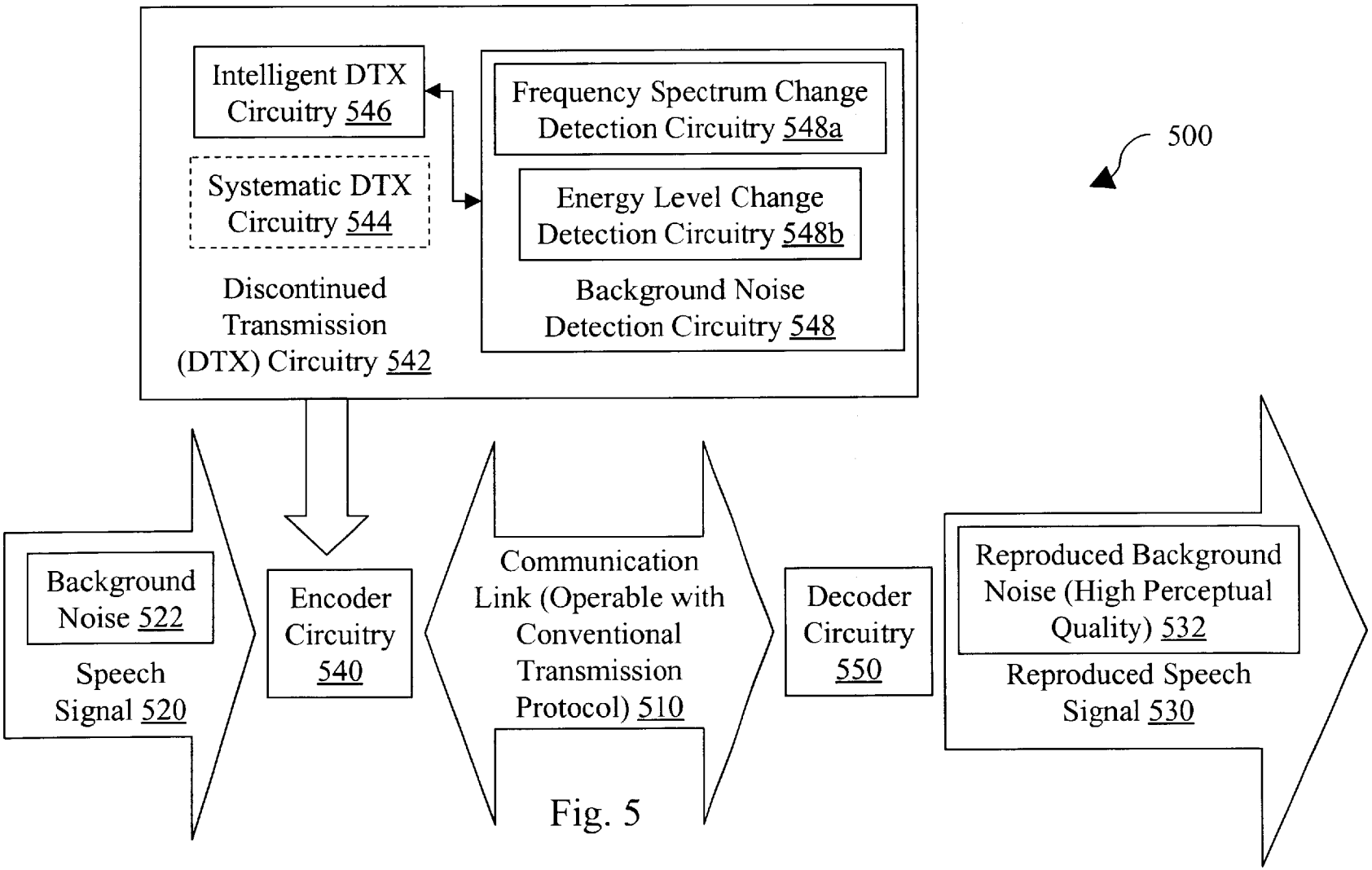
FIG. 5 is a system diagram illustrating another embodiment of a speech codec built in accordance with the present invention.

FIG. 5 is a system diagram illustrating another embodiment of a speech codec 500 built in accordance with the present invention. The speech codec 500 employs an encoder circuitry 540 and a decoder circuitry 550 to transform a speech signal 520 into a reproduced speech signal 530. The encoder circuitry 540 transforms the speech signal 520 into a form suitable for transmission via a communication link 510. If desired, the transmission protocol employed across the communication link 510 is operable with conventional transmission protocols. Any number of additional transmission protocols are operable using the communication link 510. The speech signal 520 itself contains, among other things, a background noise 522. The reproduced speech signal 530 itself contains, among other things, a reproduced background noise 532 that is of a high perceptual quality. The perceptual quality of the reproduced background noise 532 contained within the reproduced speech signal 530 is substantially indistinguishable from the background noise 522 contained within the speech signal 520.

In certain embodiments of the invention, information corresponding to a frequency spectrum and an energy level of the speech signal 520 are used to perform the speech coding of the speech signal 520 in accordance with the present invention. When the speech codec 500 begins to operate within a discontinued transmission (DTX) mode, a predetermined number of frames of the speech signal 520 are transmitted from the encoder circuitry 540 to the decoder circuitry 550 via the communication link 510. If desired, one single frame of the speech signal 520 is transmitted from the encoder circuitry 540 to the decoder circuitry 550 via the communication link 510 after the discontinued transmission (DTX) mode of operation has been invoked. Using the predetermined number of frames of the speech signal 520, or the one single frame of the speech signal 520 in other embodiments of the invention, the reproduced speech signal 530 is re-synthesized to provide the perceptually comforting comfort noise generation (CNG) to a user of the speech codec 500.

In addition, speech codec 500 is operable to detect any change in the frequency spectrum and the energy level of the speech signal 520 and to modify the speech coding performed therein. Upon the detection of any change in the frequency spectrum and the energy level of the speech signal 520 being beyond a predetermined threshold for each of the parameters of the frequency spectrum and the energy level, the speech codec 500 re-initiates the discontinued transmission (DTX) mode of operation using the new frequency spectrum and the energy level of the speech signal 520. From some perspectives, transmission is resumed between the encoder circuitry 540 and the decoder circuitry 550 via the communication link 510, whenever there is an appreciable change in either one of the frequency spectrum or the energy level of the speech signal 520. If desired, a decision to resume transmission is performed when there is an appreciable change in both the frequency spectrum and the energy level of the speech signal 520. Variations of the invention, including performing calculating weighted averages of the frequency spectrum and the energy level of the speech signal 520, are performed without departing from the scope and spirit of the invention. This updating or refreshing of the frequency spectrum and the energy level of the speech signal 520 upon the ensure a high perceptual quality of the reproduced speech signal 530, namely, a high perceptual quality of the reproduced background noise 532 contained within the reproduced speech signal 530.

The encoder circuitry 540 itself contains, among other things, a discontinued transmission (DTX) circuitry 542. The discontinued transmission (DTX) circuitry 542 itself contains, among other things, an intelligent discontinued transmission (DTX) circuitry 546 that operates cooperatively with a background noise detection circuitry 548. The background noise detection circuitry 548 itself contains, among other things, a frequency spectrum change detection circuitry 548*a* and an energy level change detection circuitry 548*b*. During the discontinued transmission (DTX) mode of operation, the intelligent discontinued transmission (DTX) circuitry 546 is operable to detect an appreciable change in either the frequency spectrum or the energy level of the speech signal 520, and the intelligent discontinued transmission (DTX) circuitry 546 resumes transmission from the encoder circuitry 540 to the decoder circuitry 550 via the communication link 510 at this time. In alternative embodiments of the invention, a systematic discontinued transmission (DTX) circuitry 544 simple transmits information corresponding to the frequency spectrum and the energy level of the speech signal 520 at predetermined intervals of time. In these embodiments of the invention, to guarantee a very high perceptual quality of speech coding of the background noise 522 during the discontinued transmission (DTX) mode of operation, the predetermined intervals of time are relatively short thereby providing ample information of the background noise 522 very frequently.

Alternatively, for applications wherein the speech codec 500 is constrained by a substantially limited bandwidth and low bit budget, the predetermined intervals of time are relatively long thereby providing perhaps a reduced perceptual quality of the background noise 522, yet other design constraints are met within this particular embodiment of the invention. If desired, both the systematic discontinued transmission (DTX) circuitry 544 and the intelligent discontinued transmission (DTX) circuitry 546 are contained within a single embodiment of the invention, and depending on the operating characteristics of the communication link 510 at any given time, the speech codec 500 is operable to switch between using the systematic discontinued transmission (DTX) circuitry 544 and the intelligent discontinued transmission (DTX) circuitry 546. For example, when a relatively large amount of bandwidth is available within the communication link 510 of the speech codec 500, the systematic discontinued transmission (DTX) circuitry 544 could be employed, thereby ensuring a high perceptual quality of the background noise 522. However, when additional considerations are met, such as a relatively constrained bandwidth of the communication link 510, the intelligent discontinued transmission (DTX) circuitry 546 thereby providing a substantial bit savings.

Figure 6A:
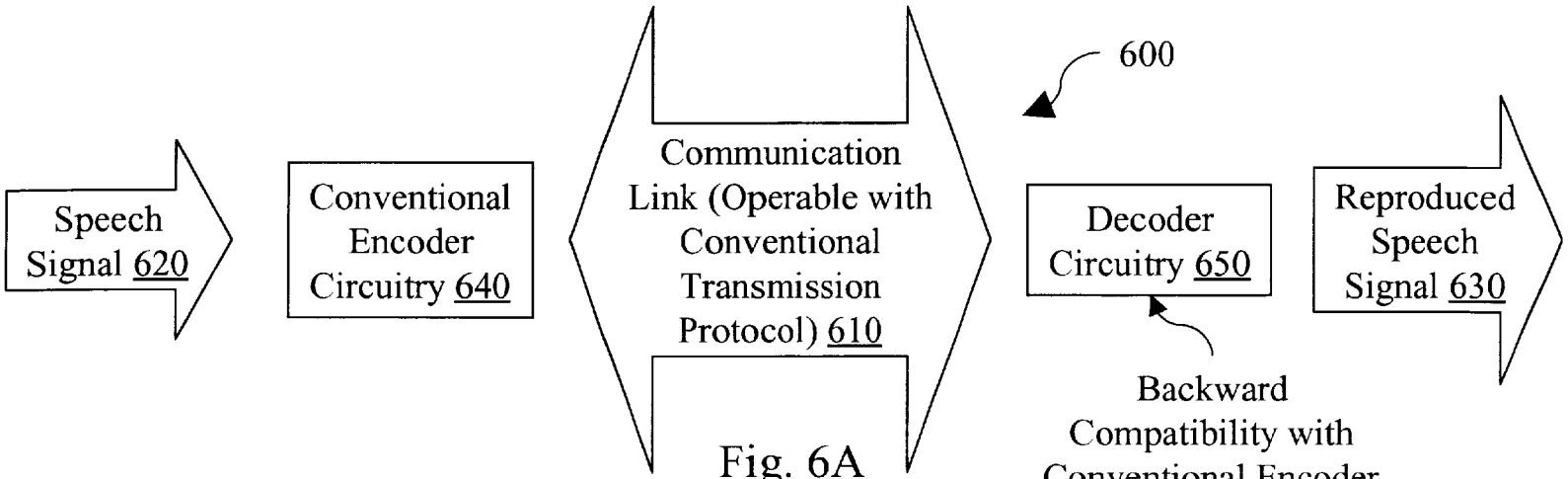
FIG. 6A is a system diagram illustrating another embodiment of a speech codec built in accordance with the present invention.

FIG. 6A is a system diagram illustrating another embodiment of a speech codec 600 built in accordance with the present invention. The speech codec 600 employs a conventional encoder circuitry 640 and a decoder circuitry 650 to transform a speech signal 620 into a reproduced speech signal 630. The encoder circuitry 640 transforms the speech signal 620 into a form suitable for transmission via a communication link 610. If desired, the transmission protocol employed across the communication link 610 is operable with conventional transmission protocols. Any number of additional transmission protocols are operable using the communication link 610. The speech signal 620 itself contains, among other things, a background noise. The reproduced speech signal 630 itself contains, among other things, a reproduced background noise that is of a high perceptual quality. The perceptual quality of the reproduced background noise contained within the reproduced speech signal 630 is substantially indistinguishable from any background noise contained within the speech signal 620.

The conventional encoder circuitry 640 is an encoder circuitry of s speech codec that is operable using a variety of conventional transmission protocols, including but not limited to the ITU-Recommendation transmission protocols with all of its associated Annexes. The decoder circuitry 650 is operable for full backward compatibility with the conventional encoder circuitry 640 and is operable to perform conventional transmission protocols over the communication link 610. One portion of the functionality proffered by the speech codec 600 is the ability for the decoder circuitry 650 to integrate completely with existing speech codecs that do not offer certain aspects of the invention as described in other embodiments of the invention. For example, other embodiments of the invention provide for maintaining a high perceptual quality of any background noise that is found in the speech signal 620. However, as described above in various embodiments of the invention and in various embodiments of the conventional art, those conventionally proposed methods of performing speech coding that maintains a high perceptual quality of the background noise that is found in the speech signal 620 are inherently incapable of integration into existing speech codecs and incapable of accommodating conventional transmission protocols contained therein.

The speech codec 600 is illustrative of one such speech codec having the decoder circuitry 650 that itself is operable to provide the increased functionality of maintains a high perceptual quality of any background noise that is found in the speech signal 620, yet the decoder circuitry 650 is operable for integration into speech codecs having portions of circuitry, namely the conventional encoder circuitry 640, that is incapable to maintain a high perceptual quality of any background noise. The speech codec 600 provides a speech codec that is capable of fall integration into both speech codecs that are operable to provide and maintain a high perceptual quality of any background noise found in the speech signal 620 and is also capable of full integration into speech codecs that contain all or part of their circuitry that is only operable to use conventional methods of discontinued transmission (DTX), silence insertion description (SID), and other methods of speech coding that provide for advanced and improved perceptual quality to an end user of the speech codec 600 or other speech codecs included within the scope and spirit of the invention.

Figure 6B:
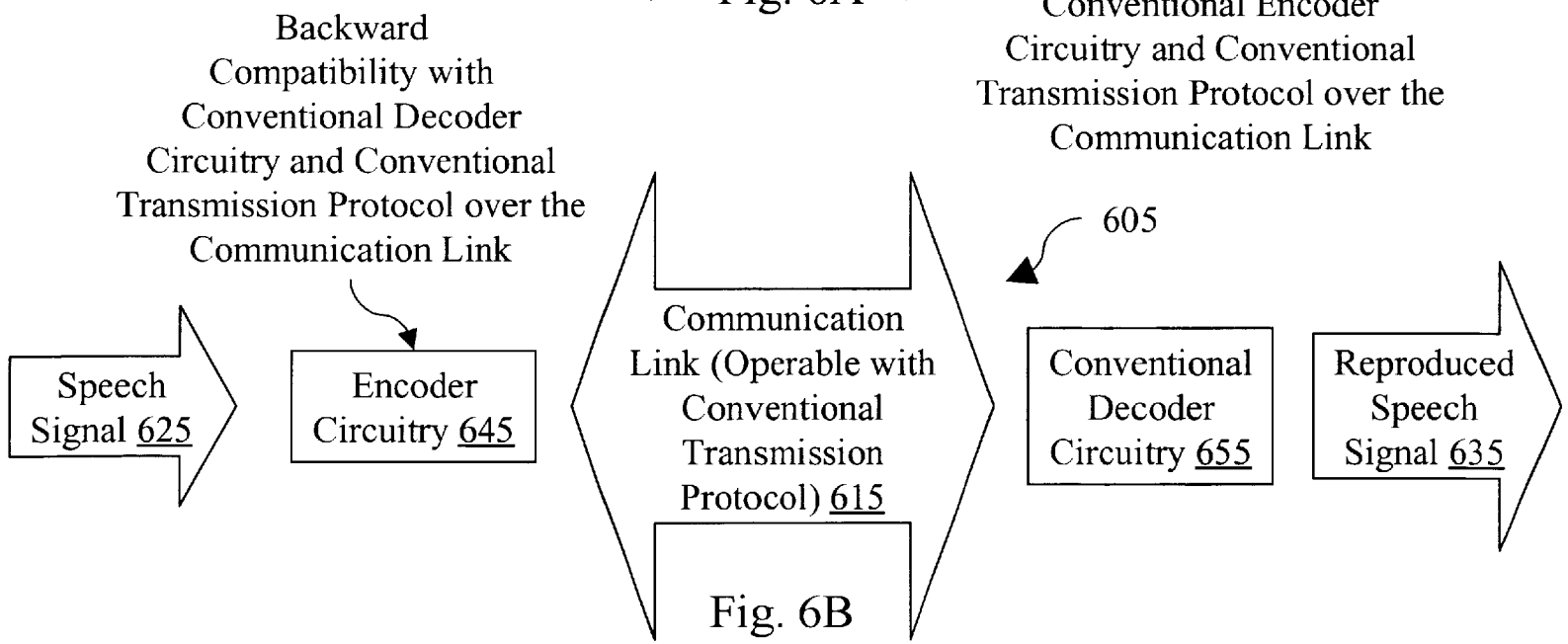
FIG. 6B is a system diagram illustrating another embodiment of a speech codec built in accordance with the present invention.

FIG. 6B is a system diagram illustrating another embodiment of a speech codec 605 built in accordance with the present invention. The speech codec 605 employs an encoder circuitry 645 and a conventional decoder circuitry 655 to transform a speech signal 625 into a reproduced speech signal 635. The encoder circuitry 645 transforms the speech signal 625 into a form suitable for transmission via a communication link 615. If desired, the transmission protocol employed across the communication link 615 is operable with conventional transmission protocols. Any number of additional transmission protocols are operable using the communication link 615. The speech signal 625 itself contains, among other things, a background noise. The reproduced speech signal 635 itself contains, among other things, a reproduced background noise that is of a high perceptual quality. The perceptual quality of the reproduced background noise contained within the reproduced speech signal 635 is substantially indistinguishable from any background noise contained within the speech signal 625.

The conventional decoder circuitry 655 is an decoder circuitry of s speech codec that is operable using a variety of conventional transmission protocols, including but not limited to the ITU-Recommendation transmission protocols with all of its associated Annexes. The encoder circuitry 645 is operable for full backward compatibility with the conventional decoder circuitry 655 and is operable to perform conventional transmission protocols over the communication link 615. One portion of the functionality proffered by the speech codec 605 is the ability for the decoder circuitry 655 to integrate completely with existing speech codecs that do not offer certain aspects of the invention as described in other embodiments of the invention. For example, other embodiments of the invention provide for maintaining a high perceptual quality of any background noise that is found in the speech signal 625. However, as described above in various embodiments of the invention and in various embodiments of the conventional art, those conventionally proposed methods of performing speech coding that maintains a high perceptual quality of the background noise that is found in the speech signal 625 are inherently incapable of integration into existing speech codecs and incapable of accommodating conventional transmission protocols contained therein.

The speech codec 605 is illustrative of one such speech codec having the encoder circuitry 645 that itself is operable to provide the increased functionality of maintains a high perceptual quality of any background noise that is found in the speech signal 625, yet the encoder circuitry 645 is operable for integration into speech codecs having portions of circuitry, namely the conventional decoder circuitry 655, that is incapable to maintain a high perceptual quality of any background noise. The speech codec 605 provides a speech codec that is capable of full integration into both speech codecs that are operable to provide and maintain a high perceptual quality of any background noise found in the speech signal 625 and is also capable of full integration into speech codecs that contain all or part of their circuitry that is only operable to use conventional methods of discontinued transmission (DTX), silence insertion description (SID), and other methods of speech coding that provide for advanced and improved perceptual quality to an end user of the speech codec 605 or other speech codecs included within the scope and spirit of the invention.

Figure 7:
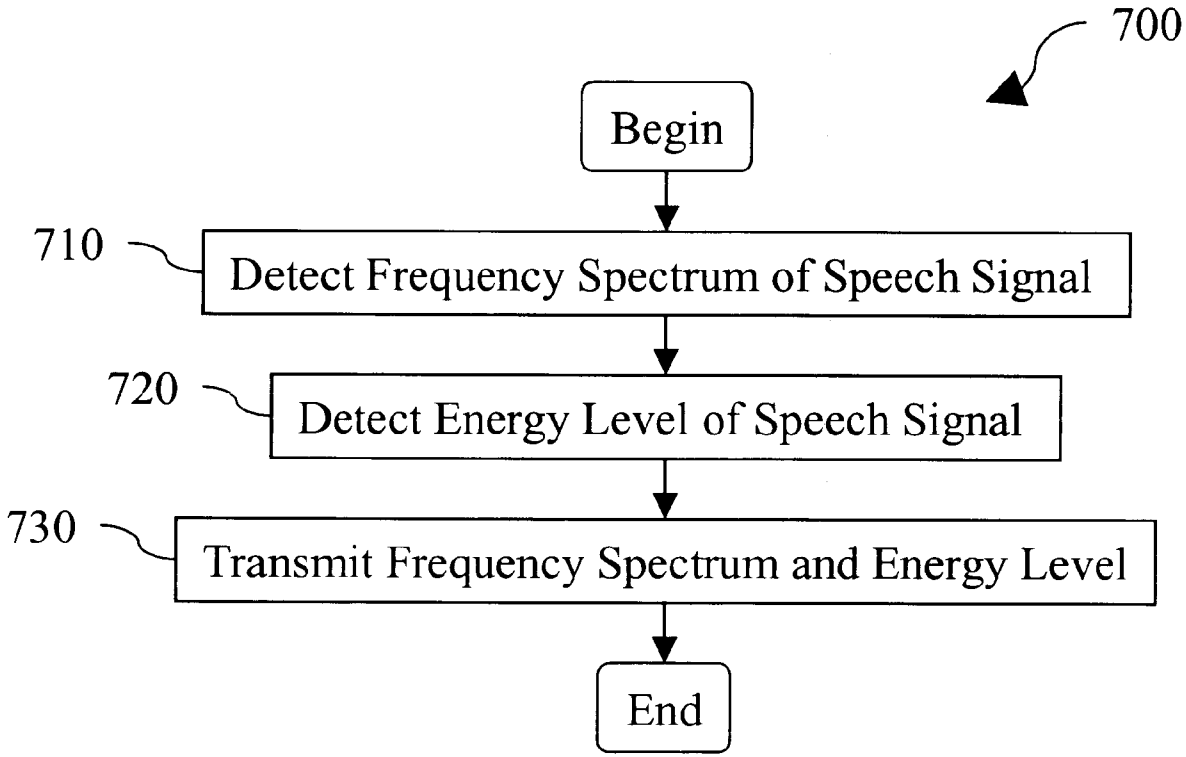
FIG. 7 is a functional block diagram illustrating on e embodiment of a speech signal transmission method that detects and transmits a frequency spectrum and an energy level of a speech signal in accordance with the present invention.

FIG. 7 is a functional block diagram illustrating one embodiment of a speech signal transmission method 700 that detects and transmits a frequency spectrum and an energy level of a speech signal in accordance with the present invention. In a block 710, a frequency spectrum of a speech signal is detected. Subsequently, in a block 720, an energy level of the speech signal is detected. Finally, in a block 730, the frequency spectrum and the energy level that are detected in the blocks 710 and 720, respectively, are transmitted. In certain embodiments of the invention, the transmission that is performed in the block 730 is via any one of the communication links described above in any of the various embodiments of the invention. For example, the frequency spectrum and the energy level are each detected of the speech signal in an encoder circuitry (within the blocks 710 and 720, respectively) and transmitted via a communication link to a decoder circuitry (within the block 730). Any variations of the detection of the frequency spectrum and the energy level of a speech signal are performed in other embodiments of the invention wherein the two parameters of the frequency spectrum and the energy level are detected and transmitted.

In certain embodiments of the invention, the detection of the frequency spectrum and the energy level in the blocks 710 and 720 is performed to ensure a high perceptual quality of any background noise contained within the speech signal. For example, by detecting the frequency spectrum and the energy level of the is in the blocks 710 and 720, and by transmitting that information in the block 730, any reproduction of the speech signal is operable to maintain the high perceptual quality of any background noise contained within the speech signal. This assurance of a high perceptual quality is especially important within various speech coding modes of operation including discontinued transmission (DTX) wherein comfort noise generation (CNG) is performed to provide to a user the perception of background noise being encoded, transmitted, and decoded and finally reproduced.

Figure 8:
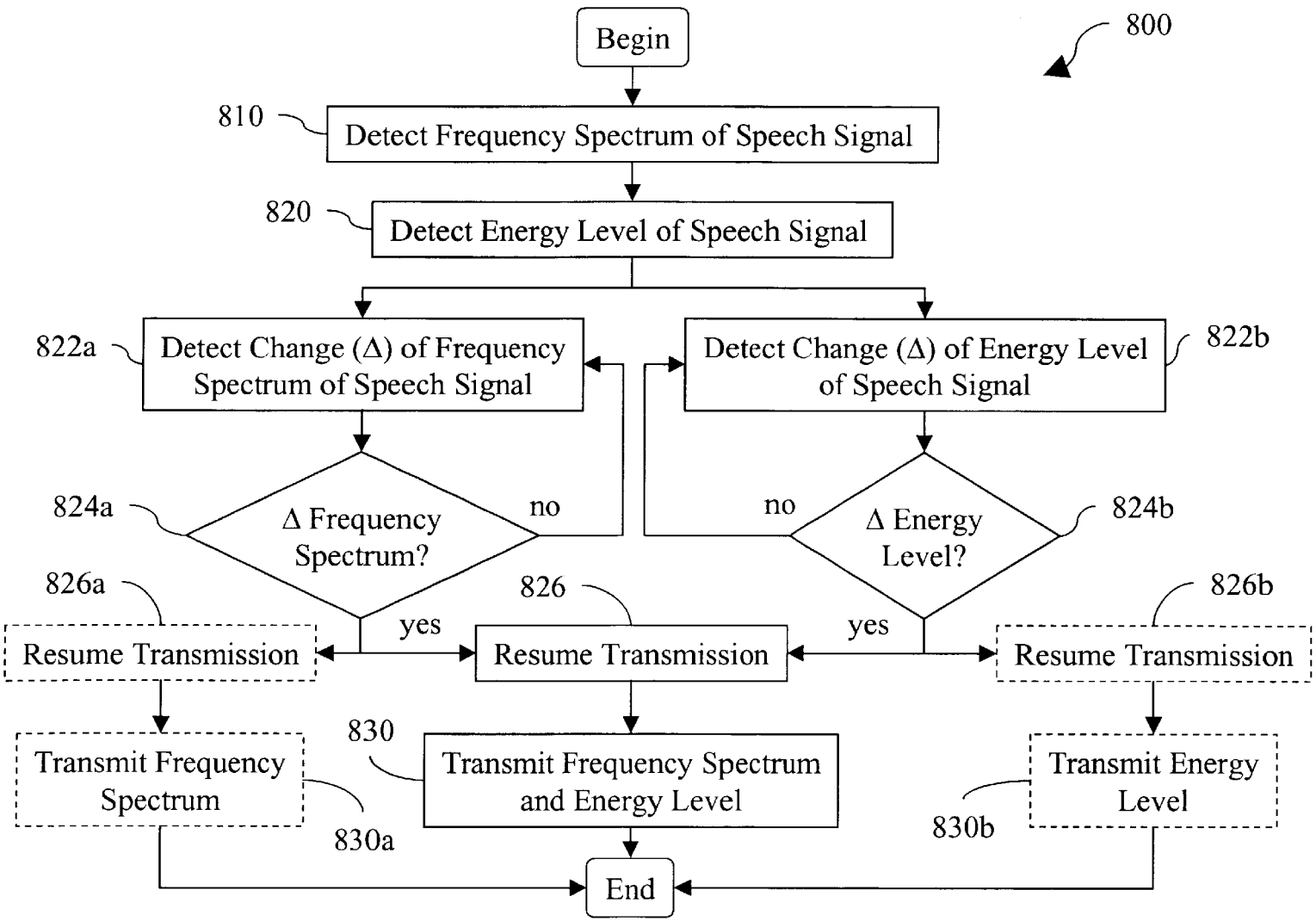
FIG. 8 is a functional block diagram illustrating one embodiment of a n energy level and a frequency spectrum monitoring method performed within a discontinued transmission (DTX) method in accordance with the present invention.

FIG. 8 is a functional block diagram illustrating one embodiment of an energy level and a frequency spectrum monitoring method 800 performed within a discontinued transmission (DTX) method in accordance with the present invention. In a block 810, a frequency spectrum of a speech signal is detected. Subsequently, in a block 820, an energy level of the speech signal is detected. Then, in a block 822*a*, any change (Δ) of the frequency spectrum of the speech signal that is detected in the block 810 is detected. Similarly, in a block 822*b*, any change (Δ) of the energy level of the speech signal that is detected in the block 820 is detected. Subsequently, in the event of the detection of any change (Δ) of the frequency spectrum of the speech signal as performed in the block 822*a*, a decision is made in the decision block 824*a* whether there is any change (Δ) of the frequency spectrum of the speech signal. Similarly, in the event of the detection of any change (Δ) of the energy level of the speech signal as performed in the block 822*b*, a decision is made in the decision block 824*b* whether there is any change (Δ) of the energy level of the speech signal.

If desired in certain embodiments of the invention, the change (Δ) of the frequency spectrum of the speech signal is compared against a predetermined threshold, so that a substantially minor change (Δ) of the frequency spectrum of the speech signal is not categorized as an "actual" change (Δ) of the frequency spectrum of the speech signal. Alternatively, intelligent schemes that are used to determine when to treat the change (Δ) of the frequency spectrum of the speech signal as an "actual" change (Δ) of the frequency spectrum of the speech signal. That is to say, a user that performs the energy level and the frequency spectrum monitoring method 800 is capable of setting various thresholds below which any change (Δ) of the frequency spectrum of the speech signal will be deemed to be simply noise. The decision performed in the decision block 824*a* is operable in the fashion described herein using thresholds and other intelligently comparative methods of comparison.

If desired in certain embodiments of the invention, the change (Δ) of the energy level of the speech signal is compared against a predetermined threshold, so that a substantially minor change (Δ) of the energy level of the speech signal is not categorized as an "actual" change (Δ) of the energy level of the speech signal. Alternatively, intelligent schemes that are used to determine when to treat the change (Δ) of the energy level of the speech signal as an "actual" change (Δ) of the energy level of the speech signal. That is to say, a user that performs the energy level and the frequency spectrum monitoring method 800 is capable of setting various thresholds below which any change (Δ) of the energy level of the speech signal will be deemed to be simply noise. The decision performed in the decision block 824*b* is operable in the fashion described herein using thresholds and other intelligently comparative methods of comparison.

In the event that there is a detected change (Δ) of the frequency spectrum of the speech signal in the decision block 824*a* or a detected change (Δ) of the energy level of the speech signal in the decision block 824*b*, transmission is resumed in a block 826. In embodiments of the invention wherein the energy level and the frequency spectrum monitoring method 800 is performed within a speech codec, the transmission that is resumed in the block 826 is that via a communication link between an encoder circuitry and a decoder circuitry. Finally, in a block 830, the frequency spectrum and the energy level that are detected in the blocks 810 and 820, respectively, are transmitted.

In alternative embodiments of the invention, after there is a detected change (Δ) of the frequency spectrum of the speech signal in the decision block 824*a*, then transmission is resumed in a block 826*a*. Afterwards, in a block 830*a*, the frequency spectrum that is detected in the block 810 is transmitted. In this embodiment of the invention, the frequency spectrum is transmitted alone without the energy level being transmitted. In even other embodiments of the invention, after there is a detected change (Δ) of the energy level of the speech signal in the decision block 824*b*, then transmission is resumed in a block 826*b*. Afterwards, in a block 830*b*, the energy level that is detected in the block 820 is transmitted. In this embodiment of the invention, the energy level is transmitted alone without the frequency spectrum being transmitted.

Figure 9:
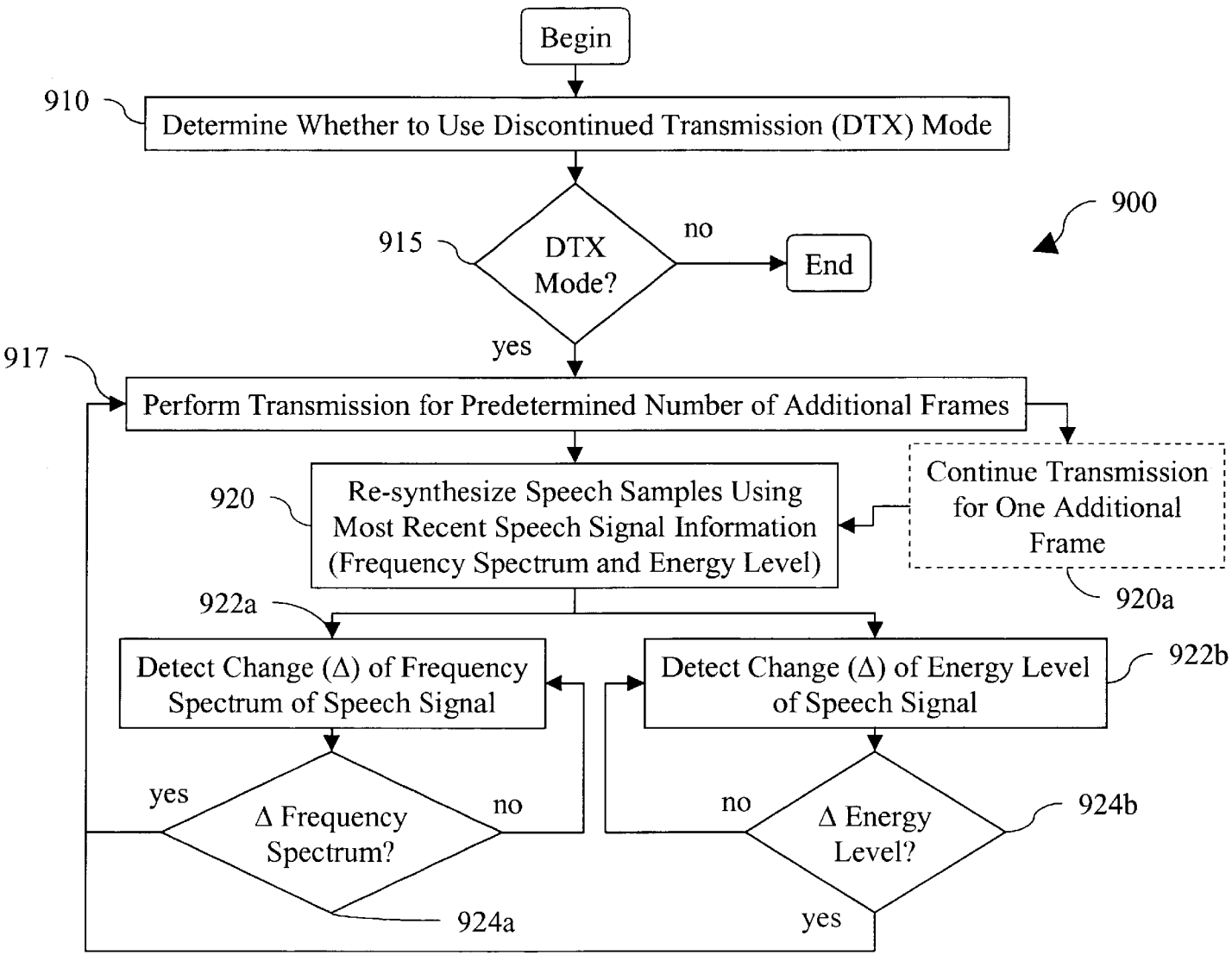
FIG. 9 is a functional block diagram illustrating a speech coding method that determines whether to perform discontinued transmission (DTX) in accordance with the present invention.

FIG. 9 is a functional block diagram illustrating a speech coding method 900 that determines whether to perform discontinued transmission (DTX) in accordance with the present invention. In a block 910, it is determined whether to use a discontinued transmission (DTX) mode of operation. In a decision block 915, it is then determined whether the discontinued transmission (DTX) mode of operation is selected in the block 910. If the discontinued transmission (DTX) mode of operation is not selected, then the speech coding method 900 terminates. Alternatively, if the discontinued transmission (DTX) mode of operation is not selected, then transmission is performed for a predetermined number of additional frames of a speech signal in a block 917. In alternative embodiments of the invention, transmission is continued for one additional frame of the speech signal. Any number of additional frames is used without departing from the scope and spirit of the invention. Subsequently, in a block 920, speech samples are re-synthesized using most recent speech signal information. In certain embodiments of the invention, this speech signal information is made up of the frequency spectrum and energy level of the speech signal.

Then, in a block 922*a*, any change (Δ) of the frequency spectrum of the speech signal is detected. Similarly, in a block 922*b*, any change (Δ) of the energy level of the speech signal is detected. Subsequently, in the event of the detection of any change (Δ) of the frequency spectrum of the speech signal as performed in the block 922*a*, a decision is made in the decision block 924*a* whether there is any change (Δ) of the frequency spectrum of the speech signal. Similarly, in the event of the detection of any change (Δ) of the energy level of the speech signal as performed in the block 922*b*, a decision is made in the decision block 924*b* whether there is any change (Δ) of the energy level of the speech signal. If there is no change in either the frequency spectrum or energy level, as decided in the decision blocks 922*a* and 922*b*, then the speech coding method 900 returns to the blocks 922*a* and 922*b*, respectively. Similar to and as described above, with respect to the comparison of the change of either frequency spectrum or energy level, the decision performed in the decision blocks 922*a* and 922*b* is operable against predetermined thresholds.

However, is any change is detected in the frequency spectrum or energy level, as decided in the decision blocks 922*a* and 922*b*, then the speech coding method 900 returns to the block 917 to transmit the predetermined number of additional frames of the speech signal. This will ensure maintenance of a high perceptual quality of background noise contained in the speech signal during the discontinued transmission (DTX) mode of operation. That is to say, the speech coding method 900 is operable to accommodate appreciable changes in either the frequency spectrum or the energy level of the background noise of the speech signal.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A speech encoder comprising:

a speech signal analysis circuitry configured to calculates a predetermined plurality of parameters from the speech signal;

a voice activity detector configured to determine voice activity in the speech signal, wherein the speech encoder enters a discontinued transmission mode of the voice activity detector does not detect voice activity; and a transmitter configured to transmit one or more speech samples of the speech signal after the speech encoder enters the discontinued transmission mode;

wherein the one or more speech samples are capable of use by a remote speech decoder to extract a parameter from the one or more speech samples in order generate a background noise base on the parameter.

2. The speech encoder of claim 1, wherein the predetermined plurality of parameters from the speech signal comprises a frequency spectrum and an energy level of the speech signal.

3. The speech encoder of claim 1, wherein the change of the at least one of the predetermined plurality of parameters is detected when the background noise detection circuitry compares the change against a predetermined threshold.

4. The speech encoder of claim 1, wherein the transmitter resumes transmission of additional one or more speech samples at predetermined time intervals.

5. The speech encoder of claim 1 further comprising:

a background noise detection circuitry that detects a change of at least one of the predetermined plurality of parameters that is calculated from the speech signal using the speech signal analysis circuitry;

wherein, while the speech encoder remains in the discontinued transmission mode, the transmitter resumes transmission of additional one or more speech samples upon the detection of the change of the at least one of the predetermined plurality of parameters.

6. The speech encoder of claim 1, wherein the parameter is a frequency spectrum.

7. The speech encoder of claim 1, wherein the parameter is an energy level.

8. A method of performing discontinued transmission for use in a speech encoder receiving a speech signal, the method comprising:

detecting no voice activity in the speech signal;

entering a discontinued transmission mode;

transmitting one or more speech samples of the speech signal while in the discontinued transmission mode; and discontinuing transmission of the speech signal after the transmitting;

wherein the one or more speech samples are capable of use by a remote speech decoder to extract parameter from the one or more speech samples in order generate a background noise base on the parameter.

9. The method of claim 8, further comprising resuming transmission of one or more speech samples of the speech signal at predetermined time intervals.

10. The method of claim 8 further comprising:

detecting a change in a frequency spectrum of the speech signal;

resuming transmission of additional one or more speech samples of the speech signal, while in the discontinued transmission mode, upon detection of the change in the frequency spectrum of the speech signal;

discontinuing transmission of the speech signal after the resuming.

11. The method of claim 10 further comprising:

detecting a change in a frequency spectrum of the speech signal;

where the resuming occurs upon detection of either the change in the energy level of the speech signal or the change in the frequency spectrum of the speech signal.

12. The method of claim 11, wherein the change in the frequency spectrum of the speech signal is determined by comparing a predetermined threshold; and the change in the energy level of the speech signal is determined by comparing a predetermined threshold.

13. The method of claim 10 further comprising:

detecting a change in a frequency spectrum of the speech signal;

where the resuming occurs upon detection of both the change in the energy level of the speech signal and the change in the frequency spectrum of the speech signal.

14. The method of claim 8 further comprising:

detecting a change in an energy level of the speech signal;

resuming transmission of additional one or more speech samples of the speech signal, while in the discontinued transmission mode, upon detection of the change in the energy level of the speech signal;

discontinuing transmission of the speech signal after the resuming.

15. A speech decoder capable of operation in a discontinued transmission mode, the speech decoder comprising:

a receiver capable of receiving one or more speech samples prior to a remote speech encoder entering the discontinued transmission mode; and a background noise reproduction circuitry for use during the discontinued transmission mode, the background noise reproduction circuitry uses the one or more speech samples to derive at least one of a spectrum frequency and an energy level to generate a background noise based on the one or more speech samples.

16. The speech decoder of claim 15, wherein the receiver receives additional one or more speech samples during in the discontinued transmission mode, and the background noise reproduction circuitry generates the background noise based on the additional one or more speech samples.

17. A method of operating during a discontinued transmission mode for use by a speech decoder, the method comprising:

receiving one or more speech samples prior to a remote speech encoder entering the discontinued transmission mode; and a background noise reproduction circuitry for use during the discontinued transmission mode, the background noise reproduction circuitry uses the one or more speech samples to derive at least one of a spectrum frequency and an energy level to generate a background noise based on the one or more speech samples.

18. The method of claim 17, wherein the receiver receives additional one or more speech samples during the discontinued transmission mode, and the background noise reproduction circuitry generates the background noise based on the additional one or more speech samples.

* * * * *

UNITED STATES PATENT AND TRADEMARK OFFICE

CERTIFICATE OF CORRECTION

PATENT NO. : 6,510,409 B1
DATED : January 21, 2003
INVENTOR(S) : Huan-Yu Su

It is certified that error appears in the above-identified patent and that said Letters Patent is hereby corrected as shown below:

Column 16,
Line 22, replace “calculates” with -- calculate --.
Line 27, replace “mode of” with -- mode if --.
Line 37, replace “base” with -- based --.

Column 17,
Line 9, replace “base” with -- based --.

Signed and Sealed this

Seventh Day of February, 2006

JON W. DUDAS
*Director of the United States Patent and Trademark Office*